United States Patent [19]

Pont et al.

[11] 4,358,266

[45] Nov. 9, 1982

[54] FLUID FUEL BURNER WITH AUTOMATIC FUEL SHUT-OFF VALVE

[75] Inventors: Richard S. Pont; John Gray, both of Edinburgh, Scotland

[73] Assignee: Laidlaw Drew & Co. Ltd., Edinburgh, Scotland

[21] Appl. No.: 94,133

[22] Filed: Nov. 14, 1979

[51] Int. Cl.[3] ..... F23N 1/02

[52] U.S. Cl. ..... 431/90; 431/14; 239/412; 239/417.3

[58] Field of Search ..... 431/14, 31, 90; 137/114; 239/412, 417.3

[56] References Cited

U.S. PATENT DOCUMENTS 1,716,325 6/1929 Rogers ..... 239/412

3,456,882 7/1969 Walker ..... 239/412

FOREIGN PATENT DOCUMENTS 177817 4/1922 United Kingdom ..... 239/412

*Primary Examiner*—Carroll B. Dority, Jr.

*Attorney, Agent, or Firm*—Felfe & Lynch

[57] ABSTRACT

An oil burner having an atomizing nozzle receptive of a supply of oil through an oil tube therein and receptive of a supply of air under pressure through an air tube therein for atomizing the oil, includes an oil shut-off valve device which is responsive to the pressure of the air in the air tube for normally preventing the passage of oil from the oil tube to the nozzle until the air pressure rises above a given value and for shutting off the passage of oil from the oil tube to the nozzle when the air pressure falls below a given value.

6 Claims, 4 Drawing Figures

FLUID FUEL BURNER WITH AUTOMATIC FUEL SHUT-OFF VALVE

BACKGROUND OF THE INVENTION

The present invention relates to fluid fuel burners and in particular oil burners having atomizing nozzles which are supplied with oil and pressurized air for atomizing the oil. Such burners are typically used in glass melting furnaces and applied vertically downwards through the crown of the furnace ports.

With oil burners of this type, when in normal use, they are fired for a 20-minute period and then shut off for a similar time. During the shut-off period, cooling air is passed through the burner to keep the nozzle cool and clean.

A problem that has developed with this type of burner during the shut-off period, is that when the fuel is shut off, a slight amount of oil remains in the burner and consequently travels to the nozzle. After-burning occurs at the fuel nozzle when the burner is left in the furnace. This after-burning acts to damage the nozzle and shorten its useful life.

In a known prior art device, a burner has an oil shut-off valve which is operated by the oil pressure therein. This burner has the disadvantage that the position of the oil shut-off valve is dependent on the oil pressure and the oil pressure is dependent in turn on the flow to the burner. This means that a highly complex control system is required on each burner to control the oil flow and a reliable shutting off of the oil flow without leaving oil in the nozzle is not obtained.

SUMMARY OF THE INVENTION

The present invention eliminates the disadvantages of the prior art oil burners and provides an oil burner with an automatic oil shut-off valve which is responsive to the pressure of the atomizing air to prevent oil from remaining in the nozzle when the burner is shut off.

The present invention also provides a visual indication that the oil shut-off valve is either in the open or closed position and a pilot valve in addition to the oil shut-off valve for providing a more positive action by the oil shut-off valve in response to the turning on and off of the atomizing air supply.

These are achieved according to the present invention in a fluid fuel burner having an atomizing nozzle receptive of a supply of fuel through a fuel tube therein and receptive of a supply of air under pressure through an air tube therein for atomizing the fuel, the fuel burner comprising fuel valving means responsive to the pressure of the air in the air tube for normally preventing the passage of fuel from the fuel tube to the nozzle until the air pressure rises above a given value and for shutting off the passage of fuel from the fuel tube to the nozzle when the air pressure falls below a given value.

The fuel valving means comprises a fuel feed passage in the nozzle having a diameter smaller than that of the fuel tube and disposed concentrically with respect thereto and a fuel shut-off rod disposed in the fuel tube and having a diameter less than that of the fuel tube to enable fuel to flow therearound and through the fuel tube and having a valve head at one end thereof nearest the nozzle and configured to close the fuel feed passage when disposed therein. Means are provided for mounting the rod for sliding movement in the fuel tube, in response to changes in air pressure, for movement between a first position wherein the valve head extends into the fuel feed passage closing same to the supply of fuel at the second position wherein the valve head is retracted into the fuel tube enabling fuel to flow therearound and into the fuel feed passage.

The mounting means comprises a piston connected to the other end of the rod and having a bearing surface thereon which defines a portion of a piston air chamber which receives air from the air tube. Spring means biases the piston against the force of the air in the piston air chamber to normally maintain the rod in the first position until the air pressure rises above a given value.

The fuel shut-off valve also includes means movable in response to the movement of the fuel shut-off rod and having a portion thereof extending outside of the burner for visually indicating whether the rod is in the first position or in the second position. In one embodiment the indicating means includes an indicator rod connected at one end to the piston and movable therewith and having the other end extending outwardly of the burner.

In order to provide for a more positive action by the fuel shut-off valve, air is communicated from the air tube to the piston air chamber via a passage having a second valving means therein responsive to the air pressure in the air passage for normally preventing passage of air from the air tube to the piston air chamber until the pressure rises above a given value and for shutting off the passage of air from the air tube to the piston chamber when the air pressure falls below a given value. In this way, the air pressure which acts on the piston is not communicated thereto until it reaches a given value thus ensuring a faster action thereon. Moreover, the fuel shut-off valve will close faster when the atomizing air pressure is reduced, since the pilot valve will sense the decrease in pressure and immediately create a zero pressure condition on the piston enabling it to shut off the fuel shut-off valve immediately.

The second valving means also has means for adjusting the spring tension on the valve by means of an adjusting screw, this giving the facility of altering the effective air pressure that will open or close the fuel shut-off valve.

BRIEF DESCRIPTION OF THE DRAWINGS

Numerous other features, objects and advantages of the invention will become apparent from the following specification when read in conjunction with the accompanying drawings in which.

DETAILED DESCRIPTION OF THE INVENTION

Figure 1:
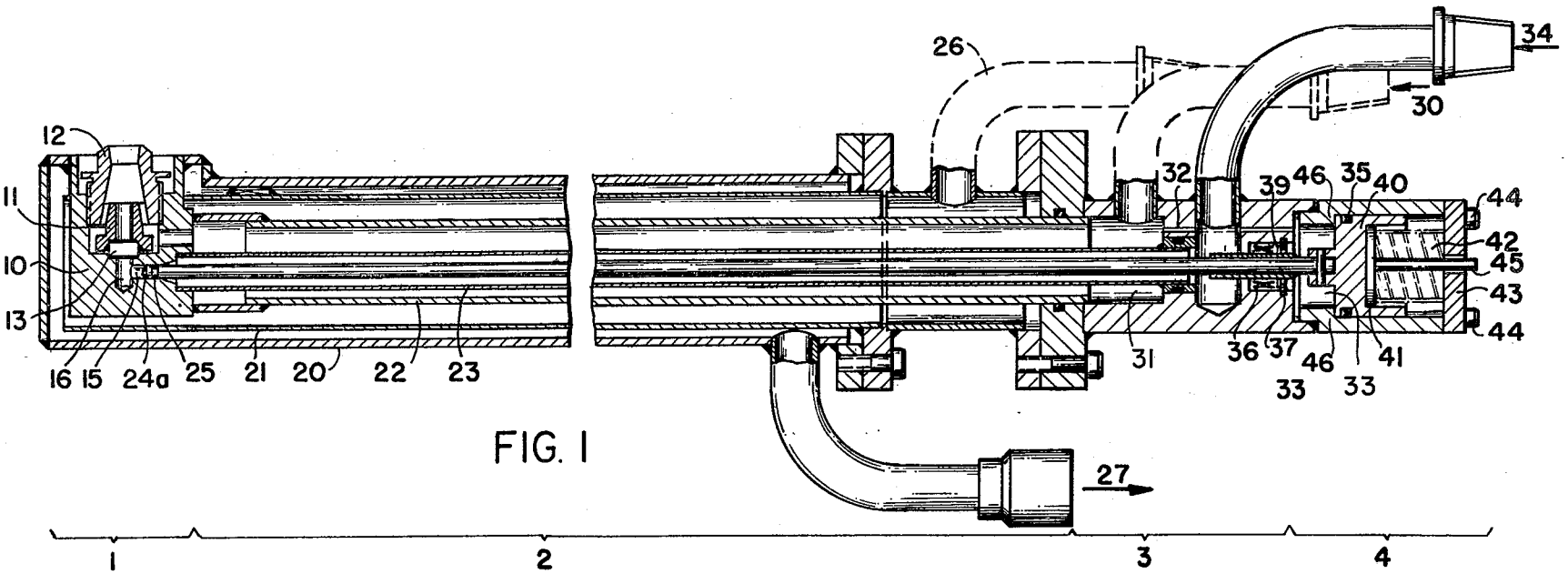
FIG. 1 is a cross-sectional view of a burner according to the present invention.
Figure 2:
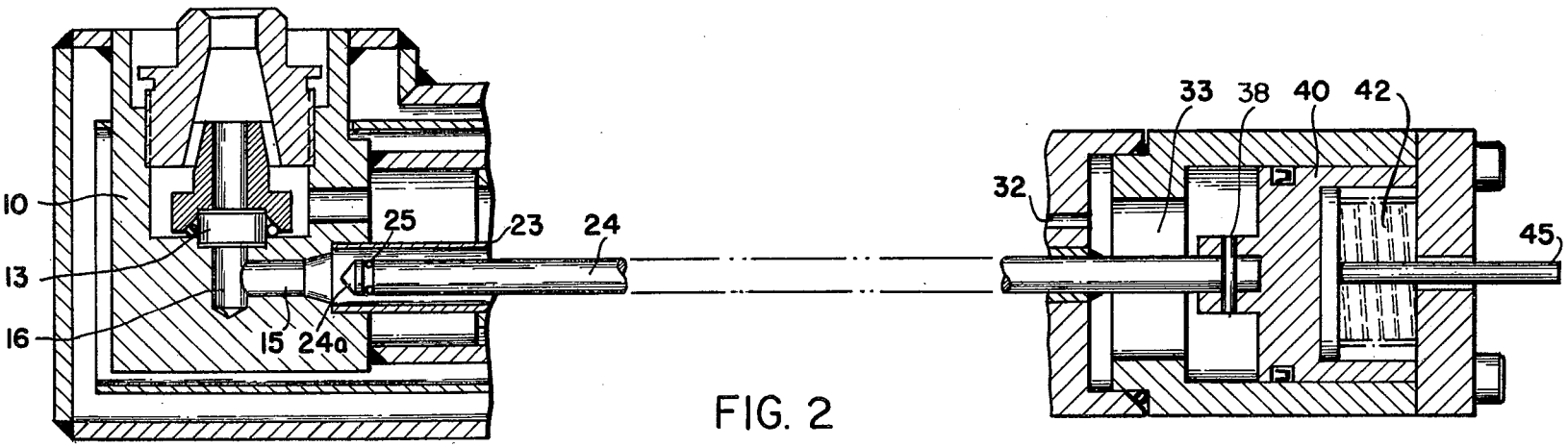
FIG. 2 is a partial detail view of FIG. 1 with the shut-off valve in the open position.

Referring now to FIGS. 1 and 2, the oil burner of the present invention has been broken down into four sections for the sake of explanation. Firstly, there is the nozzle section 1, an elongated main body section 2, a mid-body section 3 and an end section 4. Aside from the portions of the oil burner constituting the oil shut-off valve mechanism and the conventional oil burner components which have been modified to interrelate with the oil shut-off valve, the oil burner displayed in FIG. 1 is conventional in construction and, therefore, only those portions which interrelate with the improvement of the present invention are discussed herein.

The nozzle section 1 includes a nozzle block 10 having a conventional atomizer therein including swirler 11, choke 12 and pressure plate 13. The atomizing nozzle is fed with atomizing air under pressure through air inlet tube 22 which runs the length of the main body section and which receives air through air inlet 30.

The nozzle also receives the fuel input, which is preferably oil but which may be any fluid fuel which is atomizable, from oil inlet 34 which is connected to a supply of oil and which thereafter passes through oil tube 23 which extends the length of the main body section and which terminates at the nozzle and feeds passages 15 and 16. Passage 15 is disposed concentrically with oil tube 23 and has a diameter which is smaller than that of the oil tube 23.

Also illustrated is water jacket 20 and water inlet tube 21 which are fed from a water inlet 26 and which passes outwardly of the burner through water outlet 27.

The oil shut-off valving means includes oil shut-off rod 24 which is disposed in the oil tube 23 and has a diameter smaller than that of the oil tube so as to enable oil to flow around the oil shut-off rod 24 and through the oil tube 23. Oil shut-off rod 24 has a valve head 24*a* at the end thereof closest to the nozzle. The valve head 24*a* includes an O-ring 25 which is configured to be received in the oil passage 15 to seal same off when disposed therein.

The oil shut-off rod 24 is mounted for sliding movement in the oil tube 23 from a first position shown in FIG. 1 wherein the valve head 24*a* is in oil passage 15 and preventing the flow of oil from the oil tube to the nozzle and the position shown in FIG. 2 wherein the valve head 24*a* is retracted into the oil tube 23 enabling oil to flow from the oil tube 23 through passages 15 and 16 and into the atomizing nozzle.

The movement of the oil shut-off rod 24 between these two positions is effected by the structure shown in the mid-body section 3 and the end section 4 of the oil burner and which is responsive to the pressure of the atomizing air received through air inlet 30. This structure includes piston 40 which is slidably mounted in the end section 4 of the burner and limited in its movement on the one hand by shoulder 46 and on the other hand by cap plate 43 attached to the end section 4 by screws 44.

The piston 40 is connected to the other end of the oil shut-off rod 24 via locking pin 38. In order to make the movement of the piston 40 responsive to the air pressure in air tube 22, a piston air chamber 33 is provided which includes as one of its boundries bearing surface 46 of the piston 40. In order to make the piston air chamber 33 airtight, seal 35 is provided on the piston 40 along with seal 36 held in place by a washer 39 and circlip 37 around oil shut-off rod 24. Air is communicated from the air inlet 30 by providing an air inlet chamber 31 in communication with the air inlet tube 22 and a piston air feed passage 32 which connects air inlet chamber 31 to piston air chamber 33.

In order to maintain the oil shut-off valve in the closed position until the air pressure of the atomizing air reaches a given value, spring 42 is provided between seat 41 and cap plate 43 for biasing the piston towards the left in FIG. 1 and therefore, the valve head 24*a* in the closed position.

Furthermore, in order to provide a visual indication of the state of the oil shut-off valve, an indicator rod 45 is provided connected to the piston by a piston seat 41 and movable therewith. The indicator rod 45 has the other end portion thereof passing through aperture 47 in the cap plate 43 so as to be exposed to observation by a user of the oil burner.

In operation, when the burner is shut-off, air is provided at the air inlet 30 of such reduced pressure so as only to act as a coolant for the nozzle but has virtually no effect on the piston 40 due to the action of the spring 42. As the full air is turned on and the pressure is increased, air is bled off from the air inlet chamber 31 through the piston air feed passage 32 to the piston air chamber 33 wherein it acts on the bearing surface 46 of the piston 40. The piston 40 is moved to the right as the pressure is increased, however, oil does not flow into passage 15 until the O-ring 25 is retracted into the oil tube 23.

When the air pressure reaches a given value which is predetermined by spring 42 and the distance that the rod 24 must travel to the right before the oil passage 15 is opened, oil will then pass into the atomizing nozzle. The piston moves to the right in response to further increasing of the air pressure until the rear end thereof contacts the cap plate 43 as is shown in FIG. 2. In this position the oil shut-off valve is completely open so that oil can freely flow into the nozzle and be atomized by the atomizing air.

As can be clearly seen, the indicator rod 45 unmistakably indicates that the oil shut-off valve is open when it protrudes extensively as shown in FIG. 2 as opposed to it being slightly protruding in FIG. 1 and provides a clear indication that the shut-off valve is either open or closed.

When the burner is to be shut off, the air pressure from the air inlet 30 is reduced thus enabling the piston 40 under the action of spring 42 to move to the left and effect closing of the fuel passage 15. When the fuel passage 15 is closed and no more oil can pass into the nozzle, the atomizing air which is steadily reducing in pressure acts to atomize all of the remaining oil in the nozzle so that no after burning will occur.

It will be recognized by those skilled in the art that the air pressure value at which the piston closes and at which the piston will open may be different due to the hysteresis effects of the spring and any non-linearities in the spring characteristic thereof.

By selecting the spring and setting the distance of movement of the oil shut-off rod 24, the system can be set up so that when the air pressure reaches a certain preset level, oil will flow into the nozzle. This means that when the air is at the normal pressure for operating the burner, the oil valve is open and when the air pressure is reduced to the non-firing condition, the oil valve closes.

Figure 3:
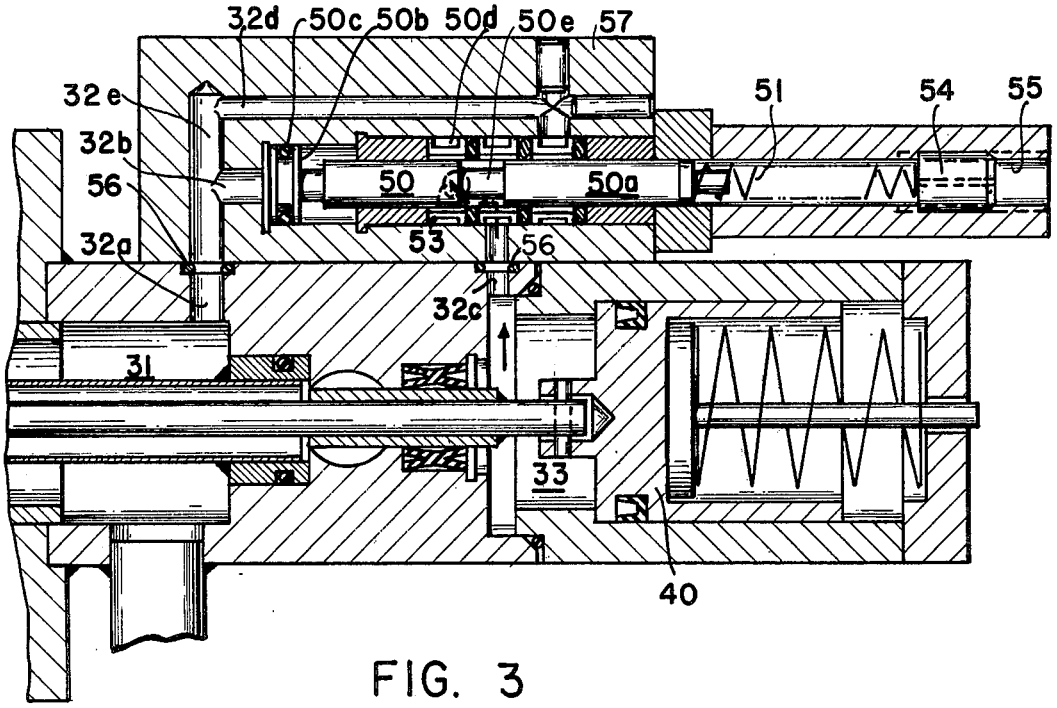
FIG. 3 is a detail view of FIG. 1 with another embodiment of the present invention.
Figure 4:
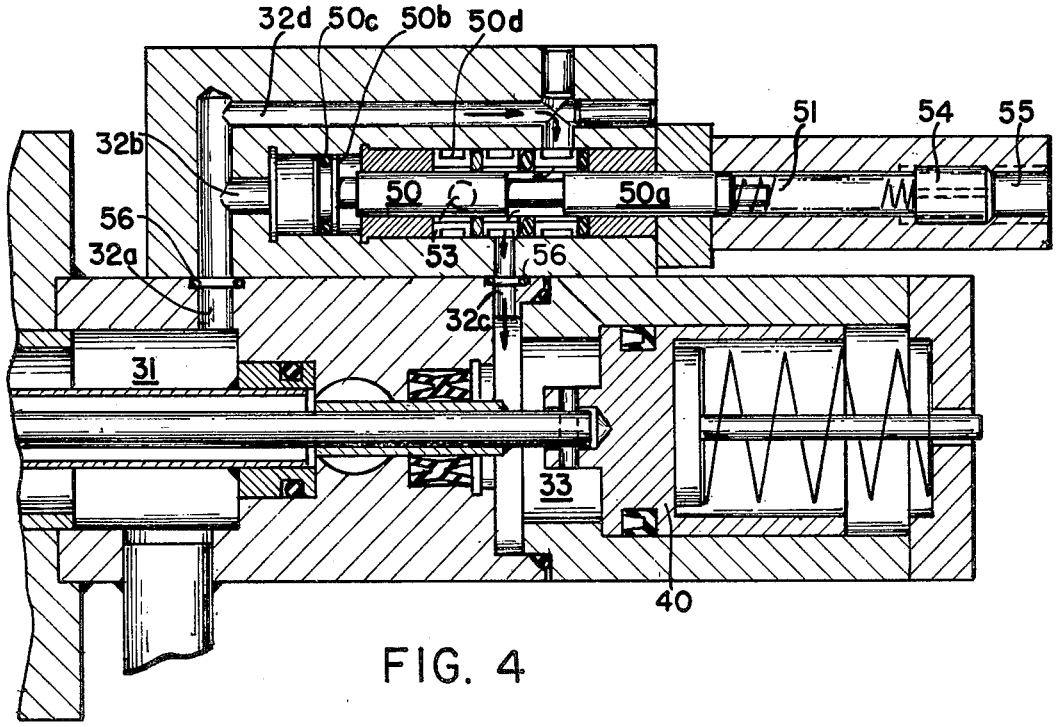
FIG. 4 is a detail view similar to that of FIG. 3 showing the pilot valve in the open position.

Because of the size of the piston and spring required for the operation above, it may be desirable to obtain a more positive action by the oil shut-off valve without changing the basic principle of operation. This is carried out by the structure shown in FIGS. 3 and 4 wherein piston air feed passage 32 is replaced by air passages 32*a*, 32*b*, 32*c*, 32*d* and 32*e* with a pilot valve arrangement disposed therebetween including piston 50 and spring 51 in housing 57.

The pilot valve arrangement is mounted to the side of the burner body by means of fixing elements such as screws. A seal is obtained between passages 32*a*, and 32*c* and air chamber 33 by means of O-ring seals 56. The piston 50 in the pilot valve is in two sections 50*a* and 50*b*. Section 50*b* is larger in diameter and has an O-ring seal 50*c* fitted therearound. Section 50*a* has a reduced diameter portion 50*e* and passes through a seal and spacer assembly 50*d* to ensure that no air passes between passages 32*b* and 32*c* when piston 50 is in the closed position.

Passages 32*a*, 32*b*, 32*d* and 32*e* are in communication with air inlet chamber 31 while passage 32*c* is in communication with piston air chamber 33. When piston 50 is in the position shown in FIG. 3, there is no communication between passages 32*a* and 32*c* and any air in piston air chamber 33 can be exhausted via passage 32*c*, reduced piston portion 50*e* and exhaust hole 53 in housing 57.

Spring 51 maintains the piston 50 in the closed position and there includes a set screw 54 which is threadably engaged in bore 55 to enable one to preset the pressure level at which air passing through passage 32*a*, 32*e* and 32*b* will push piston section 50*b* rightwardly so that passage 32*a* will be in communication with passage 32*c*.

In normal use, the full atomizing air pressure is approximately 40 pounds per square inch and thus the pilot valve is set to operate at approximately 35 pounds per square inch while the piston 40 and spring 42 can be set to operate at a far lower pressure as long as it is greater than zero pounds per square inch. A preferable value for the pressure is 25 lbs/iq$^2$. This is particularly useful in actual systems where cooling air is passed through the burner during shut-off at a pressure of 10–15 lbs/in$^2$.

In operation (in the ideal case where hysteresis is ignored) as the air pressure increases and reaches the value of 35 pounds per square inch, piston 50 will open, enabling the air to act upon the piston 40 by sealing off hole 53 and providing the path 32*a*, 32*e*, 32*d*, 50*e*, 32*c*, where upon it will open immediately due to its threshold value of less than 35 pounds per square inch. When it is desired to shut off the burner, when the air pressure is reduced to below 35 pounds per square inch, but above the threshold value of the piston 40, the piston 50 will close the passage 32*d* and open the passage 32*c* via 50*e* to exhaust hole 53 whereupon the pressure acting on the piston 40 will be zero and the valve will immediately close due to the action of spring 42.

What is claimed is:

1. In a fluid fuel burner having an atomizing nozzle receptive of a supply of fuel through a fuel tube therein and receptive of a supply of air under pressure through an air tube therein for atomizing the fuel, the improvement comprising fuel valving means responsive to the pressure of the air in the air tube for normally preventing the passage of fuel from the fuel tube to the nozzle until the air pressure rises above a given value and for shutting off the passage of fuel from the fuel tube to the nozzle when the air pressure falls below a given value, the fuel valving means comprising the fuel tube having a first diameter and a nozzle including a fuel feed passage having a diameter smaller than that of the fuel tube and disposed concentrically with respect thereto, a fuel shut-off rod disposed in the fuel tube and having a diameter less than that of the fuel tube to enable fuel to flow therearound and through the fuel tube and having a valve head at one end thereof nearest the nozzle and configured to close the fuel passage when disposed therein and means mounting the rod for sliding movement in the fuel tube, in response to changes in air pressure, between the first position wherein the valve head extends into the fuel feed passage closing same to the supply of fuel and a second position wherein the valve head is retracted into the fuel tube enabling fuel to flow therearound and into the fuel feed passage, the mounting means comprising a piston connected to the other end of the rod and having a bearing surface thereon, means including the piston bearing surface for defining piston air chamber, means for communicating air from the air tube to the piston air chamber and spring means biasing the piston against the force of the air in the piston air chamber to normally maintain the rod in the first position until the air pressure rises above a given value, wherein the air communicating means comprises an air passage between the air tube and the piston air chamber and a second valving means responsive to the air pressure in the air passage for normally preventing the passage of air from the air tube to the piston air chamber until the pressure rises above a given value and for shutting off the passage of air from the air tube to the piston air chamber when the air pressure falls below a given value.

2. The burner according to claim 1, further comprising means for visually indicating whether the rod is in the first position or the second position.

3. The burner according to claim 1, further comprising means movable in response to the movement of the fuel shut-off rod and having a portion thereof extending outside of the burner for visually indicating whether the rod is in the first position or the second position, wherein the indicating means comprises an indicator rod connected at one end to the piston and movable therewith and having the other end extending outwardly of the burner.

4. The burner according to claim 1, wherein the second valving means comprises a second valve head in the passage and spring means biasing the second valve head in a closed position wherein the passage is closed and means for adjusting the bias of the spring means to select the value of air pressure necessary to open the passage.

5. The burner according to claim 4, further comprising means for visually indicating whether the rod is in the first position or the second position.

6. The burner according to claim 4, further comprising means movable in response to the movement of the fuel shut-off rod and having a portion thereof extending outside of the burner for visually indicating whether the rod is in the first position or the second position, wherein the indicating means comprises an indicator rod connected at one end to the piston and movable therewith and having the other end extending outwardly of the burner.

* * * * *